US007798661B2

(12) United States Patent
Staiger

(10) Patent No.: US 7,798,661 B2
(45) Date of Patent: Sep. 21, 2010

(54) BACKGROUND ILLUMINATION BY NON-ELECTRICAL ENERGY SOURCES

(75) Inventor: Holger Staiger, Lauterbach (DE)

(73) Assignee: Vega Grieshaber KG, Wolfach (DE)

( * ) Notice: Subject to any disclaimer, the term of this patent is extended or adjusted under 35 U.S.C. 154(b) by 120 days.

(21) Appl. No.: 11/764,586

(22) Filed: Jun. 18, 2007

(65) Prior Publication Data

US 2008/0013301 A1 Jan. 17, 2008

Related U.S. Application Data

(60) Provisional application No. 60/830,644, filed on Jul. 13, 2006.

(30) Foreign Application Priority Data

Jul. 13, 2006 (DE) ..... 10 2006 032 457

(51) Int. Cl.
*F21K 2/00* (2006.01)

(52) U.S. Cl. ..... 362/34; 362/84; 206/219; 252/700; 313/483

(58) Field of Classification Search ..... 362/34, 362/84; 206/219; 252/700; 313/483
See application file for complete search history.

(56) References Cited

U.S. PATENT DOCUMENTS

| | | | | |
|---|---|---|---|---|
| 4,927,721 | A * | 5/1990 | Gratzel et al. | 429/111 |
| 5,557,869 | A * | 9/1996 | Douglas | 40/542 |
| 6,163,359 | A * | 12/2000 | Smith et al. | 349/161 |
| 6,750,352 | B2 * | 6/2004 | Ono et al. | 548/341.5 |
| 6,911,595 | B2 * | 6/2005 | Yoshikawa et al. | 136/263 |
| 2002/0079304 | A1 * | 6/2002 | Brandt et al. | 219/209 |
| 2004/0012947 | A1 * | 1/2004 | Hanahara et al. | 362/34 |
| 2005/0068760 | A1 * | 3/2005 | Goychrach | 362/34 |

* cited by examiner

*Primary Examiner*—Jacob Y Choi
(74) *Attorney, Agent, or Firm*—Fay Kaplun & Marcin, LLP

(57) ABSTRACT

Described is an illumination unit for a field-device display module. The illumination unit generates luminescence light as background illumination for the display. In this arrangement, the illumination element comprises a chemiluminescence element or a radioactive element that generates ionising radiation for exciting a phosphorescence layer.

18 Claims, 2 Drawing Sheets

BACKGROUND ILLUMINATION BY NON-ELECTRICAL ENERGY SOURCES

REFERENCE TO RELATED APPLICATIONS

This application claims the benefit of the filing date of German Patent Application Serial No. 10 2006 032 457.9 filed Jul. 13, 2006 and U.S. Provisional Patent Application Ser. No. 60/830,644 filed Jul. 13, 2006 the disclosure of which applications is hereby incorporated herein by reference.

FIELD OF THE INVENTION

The present invention relates to illumination devices for field device displays. In particular, the present invention relates to an illumination unit for a field-device display module, to a fill-level measuring device or a pressure gauge comprising such an illumination unit, to the use of such an illumination unit for a fill-level measuring device or pressure gauge, and to a method for illuminating a field-device display module.

BACKGROUND INFORMATION

Known field-device display modules for fill level measuring comprise illumination units that may have to be supplied with electrical current, i.e. that require additional energy sources. These modules include, for example, light emitting diodes, cold-cathode fluorescent lamps (CCFLs) or electroluminescent foils.

However, in the case of field devices it can be important to keep the energy consumption to an absolute minimum because the available energy supply is limited.

SUMMARY OF THE INVENTION

According to an exemplary embodiment of the present invention an illumination unit for a field-device display module is stated, with the illumination unit comprising an illumination element for generating luminescence light, wherein the luminescence light is adapted to illuminate the field-device display module.

Such luminescence light may be generated without the use of an electrical energy source. Rechargeable batteries or an external energy supply providing electrical current may thus no longer be required.

According to a further exemplary embodiment of the present invention, the illumination unit comprises a luminescent material.

The luminescent material is excited by way of a light source, for example by way of insolation, and is luminescent for an extended period of time after the light source has ceased to provide light.

In this way background illumination may be possible, wherein the luminescent substance does not have to be replaced or has to be replaced only rarely.

According to a further exemplary embodiment of the present invention, the illumination unit is adapted to provide background illumination for the field-device display module.

The illumination unit can thus be installed directly behind the field-device display module. For example, the illumination unit and the field-device display module can be configured as an overall module which then may be installed in the field device as a continuous component.

According to a further exemplary embodiment of the present invention, the illumination element comprises a chemiluminescence element for carrying out a chemiluminescent process for generating the luminescence light.

By a suitable selection of the chemical substances the chemical reaction that generates luminescence may be long-lasting to such an extent that replacement of the background illumination device during the service life of the field device may not be necessary or may be necessary only rarely.

According to a further exemplary embodiment of the present invention, the chemiluminescence element comprises an oxidant and a dye, which if required can be mixed so as to generate the luminescence light.

The oxidant is, for example, hypochlorite, which oxidises with the dye so that luminescence light is generated.

According to a further exemplary embodiment of the present invention, the illumination unit further comprises a first reservoir, a second reservoir and a mixing chamber, wherein the oxidant is arranged in the first reservoir, and the dye is arranged in the second reservoir, and if required the two can be introduced step-by-step to the mixing chamber where they react with each other so as to generate the luminescence light.

The light-generating chemical reaction may thus be started on demand, depending on whether or not illumination for the display is required.

According to a further exemplary embodiment of the present invention, the illumination unit further comprises a control unit for controlling a mixing rate for the oxidant and the dye.

For example, the light may be switched on or off as desired. Furthermore, by increasing or decreasing the mixing rate, the intensity of the luminescence light may be controlled. This may make it possible for the illumination intensity to be individually matched to the respective user. By switching the chemical reaction off, the quantity of used chemicals may be decreased, as a result of which energy savings may be made.

Setting the mixing rate can, for example, take place by controlling one or several corresponding pumps or valves. At a correspondingly small scale, micromechanical pumps or valves may be used which, for example, are arranged on a corresponding chip. Of course, it may however be also possible to start the reaction and to let it take its course without any further intervention until the two chemicals are used up. Subsequently, the illumination element can then be exchanged.

According to a further exemplary embodiment of the present invention, the illumination element comprises a radioactive material which is designed to generate ionising radiation.

This may, for example, be a beta radiator, for example tritium. The ionising radiation impinges on a layer, for example a layer applied to the glass body of the display, and excites this layer so that it becomes illuminated.

The radioactive material may be in place in a glass body, which subsequently is pushed behind the field-device display module.

In this way, durations of illumination of more than ten years may be achieved without additional supply of energy (depending on the quantity used and on the half-life value of the radioactive material).

According to a further exemplary embodiment of the present invention, shielding for the absorption of radioactive radiation is provided, which radiation is not radiated in the direction of the phosphorescence layer.

For example, such shielding is affixed directly to the illumination element so that the illumination element may be installed in the field device together with the shielding as a modular component.

According to a further exemplary embodiment of the present invention, the illumination unit further comprises shielding for the shielding of luminescence light that is not radiated in the direction of the display.

In this way interfering scattered light may be prevented from occurring. Furthermore, shielding may be implemented in the shape of a reflector that reflects the light back in the direction of the display. In this way the efficiency of the illumination unit may be enhanced.

According to a further exemplary embodiment of the present invention, the illumination unit further comprises an adhesive surface for fastening the illumination element to the field-device display module.

In this way simple and secure fastening of the illumination element on the display may become possible.

According to a further exemplary embodiment of the present invention, the illumination unit matches the shape of the field-device display module.

As a result of the above, fastening of the illumination unit may be facilitated. Furthermore, by matching the form, the contact between the illumination unit and the display may be improved so that the luminescence light may to a large extent be transmitted without any interference, without this resulting in unintended scatter or reflections in the region between the two units.

According to a further exemplary embodiment of the present invention, the illumination unit further comprises a field device housing, wherein the field device housing comprises a hollow space in which the illumination element can be integrated.

Since often several components may be arranged in the interior of a field device housing or in the hollow space, there might be a shortage of space in the field device housing. By providing an extra hollow space in which the illumination unit can be integrated such space problems may be avoided.

If the design shape of the illumination element matches the free space, the available space may be used optimally. Furthermore, in this way no special screw connection or other fastening of the illumination element in the housing may be necessary because said illumination element is held by the walls of the hollow space.

According to a further exemplary embodiment of the present invention, the field device housing is made from an absorbent material so that the radioactive radiation cannot escape to the outside.

According to a further exemplary embodiment of the present invention, the illumination unit is equipped for operation with a field device selected from the group comprising a fill level radar, a TDR fill level meter, an ultrasonic fill level meter, a capacitive field device, a pressure gauge and a level-detection field device.

According to a further exemplary embodiment of the present invention, a fill-level measuring device including an illumination unit described above is stated. This is, for example, a fill level radar.

Furthermore, the use of an illumination unit, described above, for a fill-level measuring device or for a pressure gauge is stated.

According to a further exemplary embodiment of the present invention, a method for illuminating a field-device display module is stated, wherein luminescence light is generated by an illumination element, and the field-device display module is illuminated with the luminescence light.

This may not require an external energy supply that provides electrical energy.

According to a further exemplary embodiment of the present invention, the method is used for providing background illumination for the field-device display module.

In this arrangement the luminescence light is generated by a chemiluminescent process or by the reaction of ionising radiation with a phosphorescence layer. Of course it is also possible to combine the two methods with each other so that both chemiluminescence light and phosphorescence light can be generated. If, for example, the brightness of the phosphorescence light is insufficient, the chemiluminescent process can be switched on as well.

Moreover, luminescence light may be generated in other ways, for example through the effect of heat (thermoluminescence). Moreover, luminescence light may be generated by the effect ultrasonic waves have on a corresponding liquid (sonoluminescence).

BRIEF DESCRIPTION OF DRAWINGS

Below, exemplary embodiments of the present invention are described with reference to the figures.

DETAILED DESCRIPTION

Figure 1:
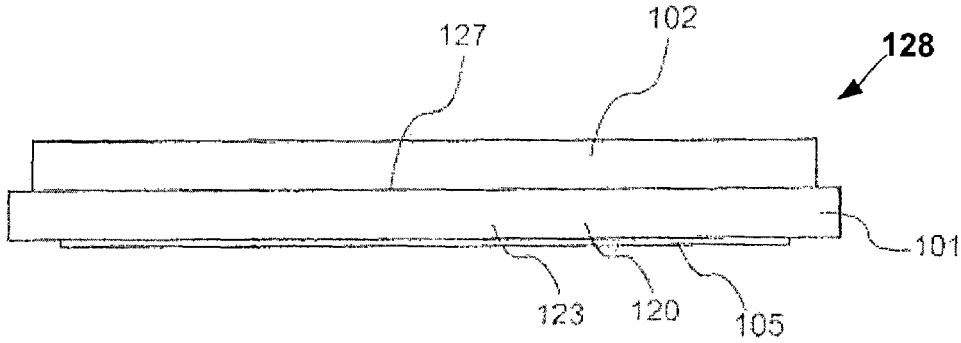
FIG. 1 shows a diagrammatic view of an illumination unit according to an exemplary embodiment of the present invention.

The illustrations in the figures are diagrammatic and not to scale.

In the following description of the figures the same reference characters are used for identical or similar elements.

FIG. 1 shows a diagrammatic view of an illumination unit according to an exemplary embodiment of the present invention. The illumination unit comprises a housing 101, in which the chemiluminescent process takes place. On the rear of the housing 101 a reflector 105 is installed, which reflector 105 reflects luminescence light that is not radiated in the direction of the display 102 towards the display. The reflector 105 may also be an absorber so that scattered light is absorbed.

Instead of a reflector 105 (or in addition to it) a heater element, for example in the form of a heating foil, may be provided in order to protect the display 102 and the illumination element 101 from icing up, or to bring it up to operating temperature.

The illumination element 101 comprises a luminescent material 123 and is installed as background illumination on the rear of the display 102. For example the illumination element 101 can be glued to the display. To this effect an adhesive layer 127 can be provided on the illumination element 101. However, other ways of attachment are also possible, for example screw connections, clamping, or a clip-like installation.

Figure 2:
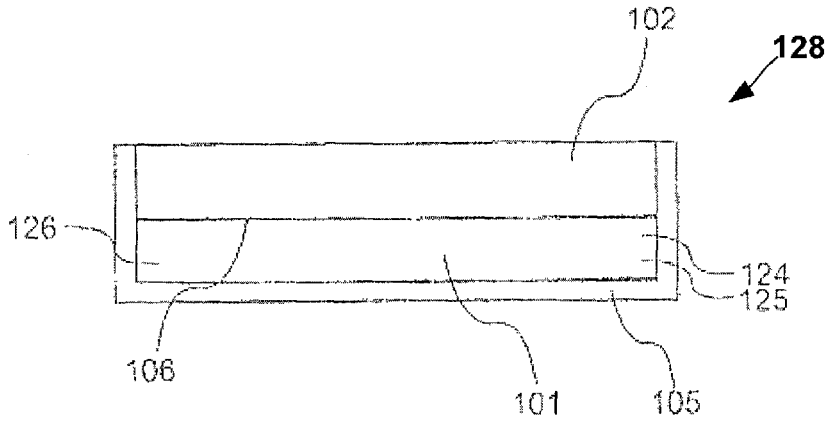
FIG. 2 shows a diagrammatic view of an illumination unit according to a further exemplary embodiment of the present invention.

FIG. 2 shows a diagrammatic view of an illumination unit according to a further exemplary embodiment of the present invention. In this arrangement the illumination element 101 is a glass body, into which a radioactive material 124 such as e.g. tritium 125 has been placed (e.g. in the form of glass capsules).

Hitherto, radioactive processes have been used for illumination in wrist watches or alarm clocks. In this arrangement the radioactive material 124 has been applied to the numerals and hands together with a corresponding phosphorescence layer.

Tritium 125 is a slightly radioactive illuminant, which among other things may also be used for numerals and hands. Tritium 125 is an isotope of hydrogen, i.e. a volatile gas. It is slightly radioactive with a half-life value of 12.3 years. Luminescent paint that is excited by tritium 125 does not need any "charging" by exterior light. The volatile gas is bonded as tritiated plastic (polymer) and with its electron radiation excites a passive illuminant (e.g. zinc sulphide) to emit visible light. The tritium 125 (or some other suitable radioactive material 124) can be firmly embedded in a Borosit glass capsule or the like. Within approximately 12 years the number of tritium atoms is reduced by approximately 75% as a result of natural decomposition. However, the human eye still perceives this value as half as bright as the full output.

The minute illumination bodies, which are closed up at high pressure so as to be airtight, are resistant to water, oil and most corrosive materials. External temperatures (−170° Celsius to +400° Celsius) and temperature shocks pose not problem to the tritium gaslight source illumination system.

The radioactive material emits radioactive radiation (e.g. in the form of beta particles from a β-radiator 126). This radiation impinges on a phosphorescence layer 106, which has been applied to the glass body 101, and excites the latter to illuminate. The imitated luminescence light is a type of cold-light radiation. With the material tritium 125 said layer is illuminated for at least ten years without there being a need for any further energy supply.

Furthermore, shielding 105 is provided, which surrounds the glass body 101 on all sides except for the side facing the display 102. Such shielding 105 can be installed directly on the glass body 101 so that from the overall-module display illumination unit 102 in total no radioactivity or only a very small quantity of radioactivity issues.

Figure 3:
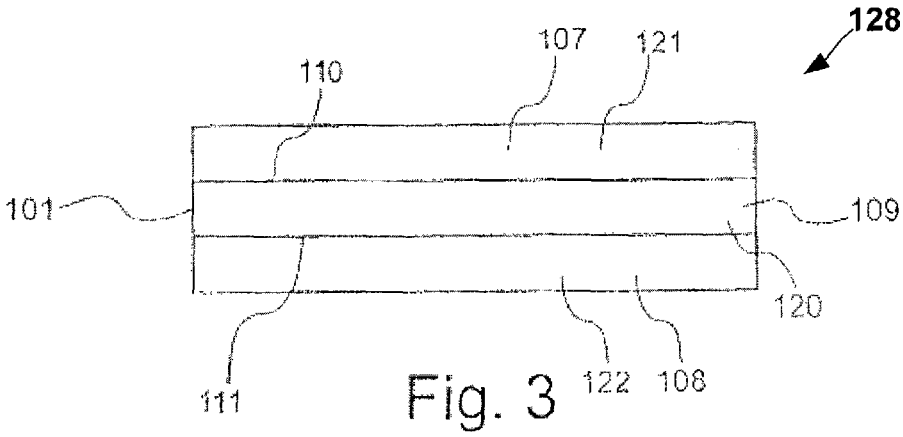
FIG. 3 shows a diagrammatic view of an illumination unit according to a further exemplary embodiment of the present invention.

FIG. 3 shows a diagrammatic view of an illumination unit, installed on a field-device display module 102, according to a further exemplary embodiment of the present invention. The illumination element 101 is a chemiluminescence element 120 (as is also the case in FIG. 1). In this arrangement the illumination element 101 comprises two reservoirs 107, 108 which can release oxidant 121 or dye 122 to a mixing chamber 109. For example, the mixing chamber is arranged between the two reservoirs 107, 108. However, other arrangements may also be possible.

Between the reservoirs 107, 108 and the mixing chamber 109 there are partitions 110, 111 that can be opened if required. For example, controllable openings or pumps are installed in the partitions 110, 111, which openings or pumps can control the rate of release of the corresponding chemicals from the reservoirs to the mixing chamber.

In this way the light intensity and the duration of luminescence light generation may be controlled.

By means of this chemical process, luminescence light is generated, and the display 102 is illuminated. With a selection of suitable chemicals or with corresponding control of the mixing rate, the service life of the illumination unit may be prolonged to such an extent that no exchange is required.

Figure 4:
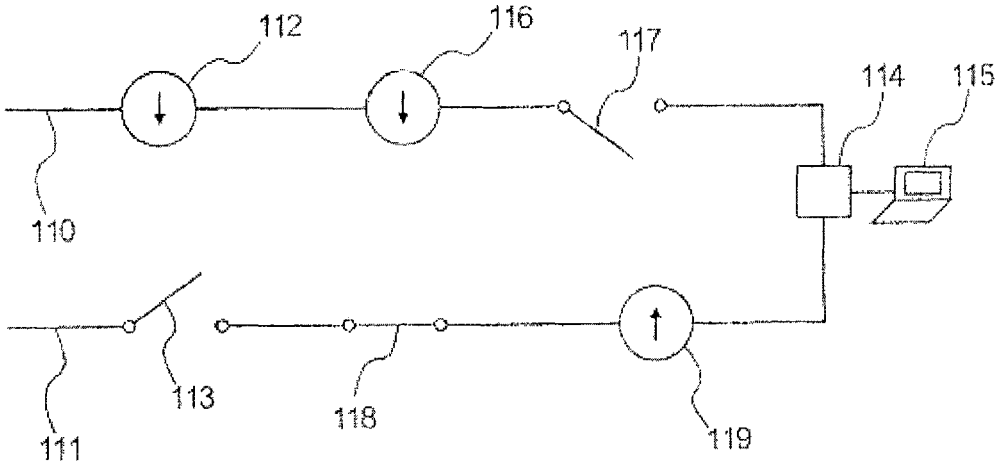
FIG. 4 shows a diagrammatic view of a control system for mixing the chemical substances for generating luminescence light according to an exemplary embodiment of the present invention.

FIG. 4 shows a diagrammatic view of a control system for setting the mixing rate between the oxidant and the dye. Pumps 112, 116, 119 and valves or flaps 113, 117, 118 are installed in the partition walls 110, 111, which pumps 112, 116, 119 and valves or flaps 113, 117, 118 can be controlled or regulated by way of an electronic control unit 114. The pumps and valves/flaps 112, 116, 119, 113, 117, 118 are, for example, micromechanical pumps and flaps/valves that can be integrated on a chip.

Furthermore, a light sensor (not shown in FIG. 4) or further sensors, for example a timer, can be connected to the control unit 114. In this way the mixing rate can be set, depending on the time of day or depending on exterior light levels. Moreover, a computer 115 is connected to the control unit 114, which computer 115 controls a corresponding mixing program. The control program that runs on the computer 115 can correspondingly be programmed by the user, depending on the requirements.

Figure 5:
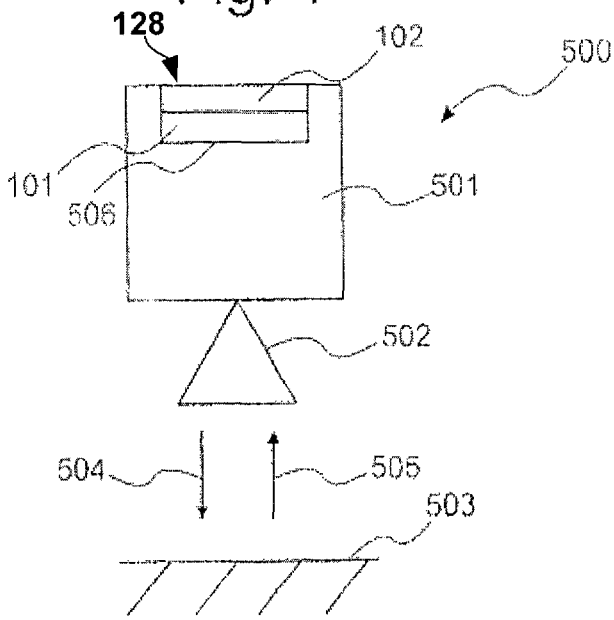
FIG. 5 shows a diagrammatic view of a fill level radar according to an exemplary embodiment of the present invention.

FIG. 5 shows a diagrammatic view of a fill level radar according to an exemplary embodiment of the present invention.

In this arrangement the fill level radar 500 comprises a housing 501 and an antenna 502. The housing 501 serves to accommodate the transmit-/receive electronics and the field-deice display module 128 with the illumination unit. To this effect a corresponding hollow space 506 is provided in the housing 501.

The antenna 502 is used to emit a transmit signal 504 that is reflected on the fill level surface 503 and is received by the antenna as a receiving signal 505.

Figure 6:
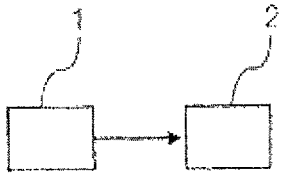
FIG. 6 shows a flow chart of a method according to an exemplary embodiment of the present invention.

FIG. 6 shows a flow diagram of a method according to an exemplary embodiment of the present invention. In a first step the luminescence light is generated by an illumination element. In order to generate the luminescence light, for example a chemiluminescent reaction within the illumination unit takes place. As an alternative or in addition to this, ionising radiation can be generated in the illumination unit, which ionising radiation excites a phosphorescent layer so that said layer then emits luminescence light in the form of phosphorescence light. In a second step the field-device display module is illuminated with the luminescence light, for example from the back as background lighting.

In addition, it should be pointed out that "comprising" does not exclude other elements or steps, and "a" or "one" does not exclude a plural number. Furthermore, it should be pointed out that characteristics or steps which have been described with reference to one of the above exemplary embodiments can also be used in combination with other characteristics or steps of other exemplary embodiments described above. Reference characters in the claims are not to be interpreted as limitations.

What is claimed is:

1. A field-device display module, comprising: an illumination unit, the illumination unit including:

a display;

an illumination element generating luminescence light;

wherein the luminescence light illuminates the field-device display module, wherein the illumination element is installed in the illumination unit as background illumination on a rear portion of the display, wherein the illumination element includes a chemiluminescence element which carries out a chemiluminescent process for generating the luminescence light, and wherein the chemiluminescence element includes an oxidant and a dye, the oxidant and the dye being mixed so as to generate the luminescence light; and a computer which controls a valve, the valve one of increasing and decreasing a mixing rate of the oxidant and the dye to control an intensity of the luminescence light.

2. The field-device display module according to claim 1, further comprising:

a first reservoir;

a second reservoir; and a mixing chamber;

wherein the oxidant is arranged in the first reservoir, and the dye is arranged in the second reservoir, and the oxidant and the dye being introduced step-by-step to the mixing chamber where the oxidant and the dye react with each other so as to generate the luminescence light.

3. The field-device display module according to claim 1, wherein the illumination element includes a luminescent material.

4. The field-device display module unit according to claim 3, wherein the illumination element includes a radioactive material which generates ionising radiation.

5. The field-device display module according to claim 3, wherein the illumination element includes a phosphorescence layer which is excited by the ionising radiation so that luminescence light in the form of phosphorescence light arises.

6. The field-device display module according to claim 4, wherein the radioactive material includes β-radiator.

7. The field-device display module according to claim 4, wherein the radioactive material includes tritium.

8. The field-device display module according claim 4, further comprising:

a shielding absorbing of ionising radiation which is not radiated in the direction of the phosphorescence layer.

9. The field-device display module according to claim 1, further comprising:

a shielding arrangement shielding luminescence light which is not radiated in the direction of the display.

10. The field-device display module according to claim 1, further comprising:

an adhesive surface fastening the illumination element to the field-device display module.

11. The field-device display module according to claim 1, wherein the illumination unit matches a shape of the field-device display module.

12. The field-device display module according to claim 1, further comprising:

a field device housing including a hollow space, wherein the illumination element is integrated in the hollow space.

13. The field-device display module according to claim 1, wherein the illumination unit is utilized with a field device selected from a group comprising of: a fill level radar, a TDR fill level meter, an ultrasonic fill level meter, a capacitive field device, a pressure gauge and a level-detection field device.

14. A fill-level measuring device, comprising:

a field-device display module;

a display; and an illumination unit including an illumination element which generates luminescence light, the luminescence light illuminating the display module, wherein the illumination unit provides background illumination for the field-device display module, and wherein the illumination element is installed in the illumination unit as background illumination on a rear portion of the display, wherein the illumination element includes a chemiluminescence element which carries out a chemiluminescent process for generating the luminescence light, wherein the chemiluminescence element includes an oxidant and a dye, the oxidant and the dye being mixed so as to generate the luminescence light, and wherein the field-display module includes a computer which controls a valve, the valve one of increasing and decreasing a mixing rate of the oxidant and the dye to control an intensity of the luminescence light.

15. A pressure gauge, comprising:

a field-device display module;

a display; and an illumination unit including an illumination element which generates luminescence light, the luminescence light illuminating the display module, wherein the illumination unit provides background illumination for the field-device display module, and wherein the illumination element is installed in the illumination unit as background illumination on a rear portion of the display, wherein the illumination element includes a chemiluminescence element which carries out a chemiluminescent process for generating the luminescence light, wherein the chemiluminescence element includes an oxidant and a dye, the oxidant and the dye being mixed so as to generate the luminescence light, and wherein the field-display module includes a computer which controls a valve, the valve one of increasing and decreasing a mixing rate of the oxidant and the dye to control an intensity of the luminescence light.

16. A method for illuminating a field-device display module, comprising:

generating luminescence light using an illumination element; and illuminating the field-device display module with the luminescence light, wherein the illumination element is installed in the illumination unit as background illumination on a rear portion of the display, wherein the illumination element includes a chemiluminescence element which carries out a chemiluminescent process for generating the luminescence light, and wherein the chemiluminescence element includes an oxidant and a dye; and operating a computer to control a valve, the valve one of increasing and decreasing a mixing rate of the oxidant and the dye to control an intensity of the luminescence light.

17. The method according to claim 16, wherein the illumination unit provides a background illumination for the field-device display module.

18. The method according to claim 16, wherein the luminescence light is generated by ionising radiation of a radioactive material, a phosphorescence layer is excited using the radiation so that luminescence light in a form of phosphorescence light arises.

* * * * *